US005762404A

United States Patent [19]

Drumm

[11] Patent Number: 5,762,404

[45] Date of Patent: Jun. 9, 1998

[54] MODIFICATION OF STRIP BRUSH

[76] Inventor: Arthur E. Drumm, 14808 Hillview Rd., Marysville, Ohio 43040

[21] Appl. No.: 744,601

[22] Filed: Nov. 7, 1996

[51] Int. Cl.[6] ..... A46D 1/00

[52] U.S. Cl. ..... 300/21

[58] Field of Search ..... 15/182, 183, 179, 15/195, 197, 198; 300/21

[56] References Cited

U.S. PATENT DOCUMENTS 3,704,915 12/1972 Schofield ..... 300/21
5,251,355 10/1993 Drumm ..... 300/21
5,358,311 10/1994 Drumm ..... 300/21
5,358,312 10/1994 Drumm ..... 300/21
5,445,438 8/1995 Drumm ..... 300/21
5,606,762 3/1997 Droeser et al. ..... 300/21

*Primary Examiner*—Mark Rosenbaum
*Attorney, Agent, or Firm*—Kremblas Foster Millard & Pollick; Sidney W. Millard

[57] ABSTRACT

A bristle strip includes a channel, a mat, staples and nails. The mat is made of a plurality of bristles. The staples penetrate the channel and the mat and one staple is placed within one-half inch of each end of the channel to retain the bristles therein. The nails are inserted in each end of the channel to further ensure retention of the bristles.

4 Claims, 4 Drawing Sheets

MODIFICATION OF STRIP BRUSH

FIELD OF THE INVENTION

This invention relates generally to brushes which can be mounted on a rotary drum, and more specifically to an improved structure for retaining the bristles of the brush within a channel.

BACKGROUND OF THE INVENTION

Strip brushes similar to the one disclosed herein include the brushes disclosed in several commonly owned patents to Drumm. These include U.S. Pat. No. 5,251,355; 5,358,311; 5,358,312; and 5,4445,348, the disclosures of which are incorporated herein by reference. These four patents are believed to be the best prior art.

Rotary drum brushes which are presently made commonly include bristle strips attached to a rotary drum. The strips are mounted so that they may be removed easily. Since the bristles are known to wear out over time, it is also important to use a system wherein the strips may be easily interchanged.

However, over time it has been discovered that even with the improved strips used in the prior art, the bristles in the mat on the ends of the bristle strips tend to loosen and detach from the channel. As a result, the remaining bristles then loosen and work their way out to the end to become detached as well. This creates a problem in that the bristle strip is less effective and requires more frequent changing. Thus, an improved design is necessary to retain the bristles in the bristle strip.

All of the four patents listed above disclose the use of a longitudinally extending retaining cord at the bottom of the U-shaped bristle strip. The present invention omits the retaining cord. It has been found that while the retaining cord provides some protection against the bristles loosening and detaching, it is better to provide a mechanism in the mat itself which will hold the bristles together.

In addition, it is important that the means which secures the bristles and the channel together be placed very close to the ends of the channel so that fewer bristles are left unsecured at the ends of the mat.

An additional feature in the present invention is the use of a nail and sleeve mechanism inserted in the ends of the mat and channel. Such a device serves to prevent any unstable bristles from loosening and detaching.

SUMMARY OF THE INVENTION

The present invention is an improved bristle strip. The bristle strip includes primarily a channel, a mat, and a plurality of staples for securing the mat in the channel. The channel has a first side which includes a first flange and a first ear, and a second side including a second flange and a second ear. The channel includes a front end, a rear end and a length. At least one of the first flange and the second flange includes a bevel at the front end of the channel to assist in the insertion of the bristle strip into the mounting track or slide secured to the periphery of the drum. The mat includes a plurality of bristles and at least one securing strip which secures the bristles together to form the mat. The staples which secure the mat and channel together penetrate the first side of the channel, through the mat and then through the second side of the channel where the ends are deflected in an unconventional fashion. One of the staples is placed within one-half inch of the front end of the channel and one of the staples is placed within one-half inch of the rear end of the channel. A nail is also placed in each of the front end and rear end for retaining the mat in the channel.

The nail which is placed in the ends of the channel also may include a disc shaped flange which will surround the nail and be sandwiched between the nail head and the end of the bristle strip. The sleeve may be plastic and the nail may be metal.

The securing strip may include metal wires woven through the mat. Preferably, the securing strip includes five wires woven through the mat.

Placement of the staples in close proximity to the ends of the channel is achieved primarily through the use of the bevel at the end of the strip. The bristle strip is formed by providing a mat with a plurality of bristles having at least one securing strip to secure the bristles together. A channel including all the elements mentioned above is also provided. The mat is then folded into a U-shape with the securing strip at the bottom of the U and placed in the channel. A number of these channels having had mats placed in them are aligned in sequence and are sent into a stapler. The front end of each channel is inserted and a sensor detects the presence of the bevel which activates the stapler. As a result a staple will be released within one-half inch of the front of the channel. As the channel moves along, the stapler will staple at certain preselected distances. When the sensor detects the bevel of the next channel, the stapler will place a staple within one-half inch of the trailing end of the channel preceding the detected bevel and then within one-half inch of the front end of the succeeding channel. In this way the staples are placed sufficiently close to the ends of the channel and the mat is more easily retained. A nail is then driven into the end of the stapled mat and channel combination for providing further assurance that the mat will be retained in the channel.

It will be clear that a continuous channel bearing bristles could be notched and severed to length at the entrance to the stapling machine rather than cutting the strip to length prior to arriving at the stapling machine.

Objects of the invention not clear from the above will be fully understood upon a review of the drawings and the description of the preferred embodiments which follows.

DETAILED DESCRIPTION OF THE PREFERRED EMBODIMENT

Figure 1:
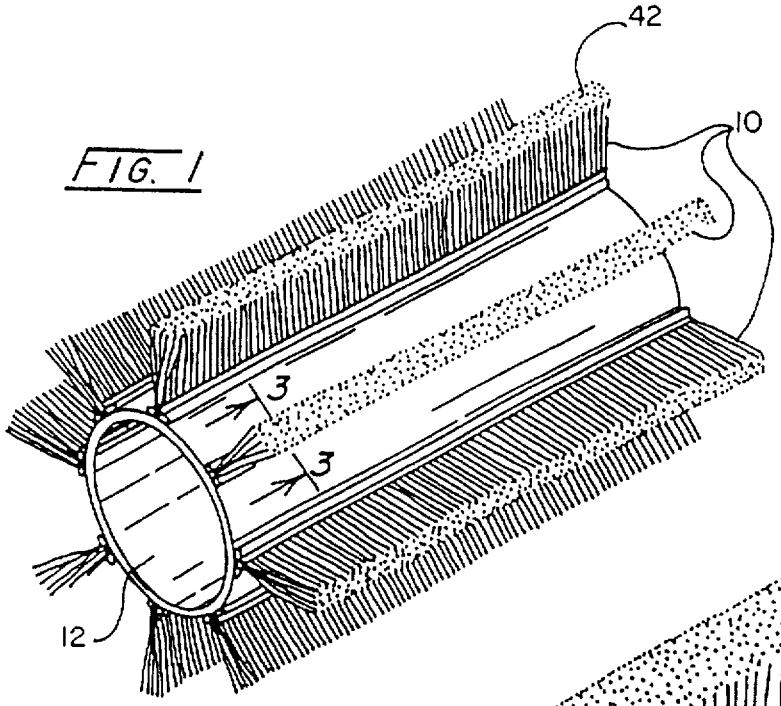
FIG. 1 is a perspective view of a drum having a plurality of bristle strips mounted thereon in a straight, parallel, angularly spaced relationship.
Figure 2:
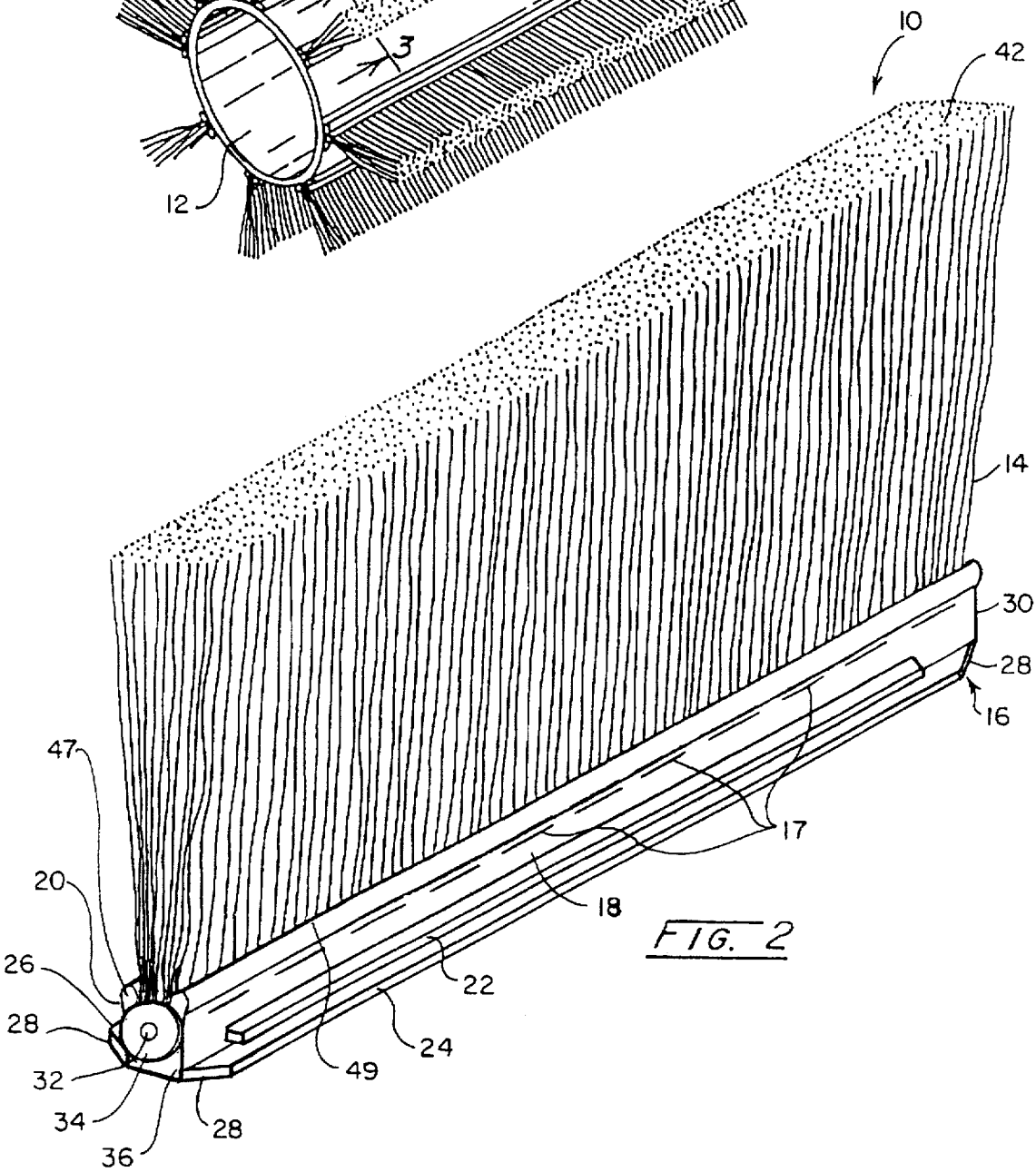
FIG. 2 is an enlarged perspective view of a single bristle strip in accordance with the invention.

Referring generally to the figures, and most particularly to FIGS. 1 and 2, the invention relates to bristle strips marked generally as number 10 which may be used in conjunction with a rotary brush drum 12. Bristle strip 10 includes channel 16, a bristle mat 14 placed within channel 16, and a plurality of staples 17 for securing the mat 14 in the channel 16.

Figure 3:
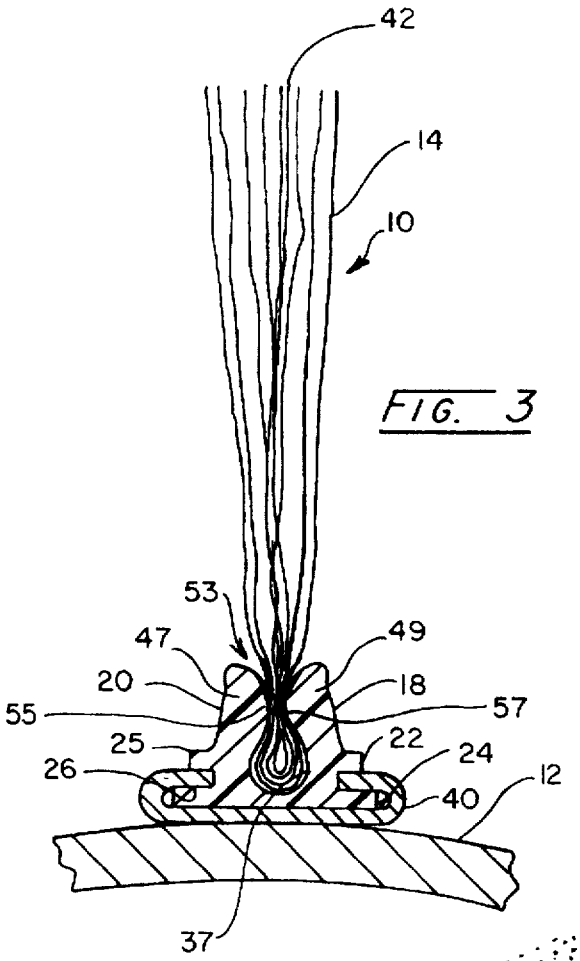
FIG. 3 is a sectional view taken along line 3—3 of FIG. 1.

Turning to FIGS. 2 and 3, it may be seen that channel 16 includes a first side 18 and a second side 20. First side 18 includes a first ear 22 and a first flange 24. Second side 20 includes second ear 25 and second flange 26. Channel 16 also includes front end 30 and rear end 36. Channel 16 includes a longitudinally extending tear drop shaped recess 37 designed to receive and retain the bristle mat 14. Channel 16 is preferably made of a thermoplastic resin. Suitable resins comprise polypropylene, polyurethane, polyethylene, polyvinylchloride, and the like which are flexible but tough enough that staples or nails penetrating the channel will not rip out during the sweeping operation.

Figure 4:
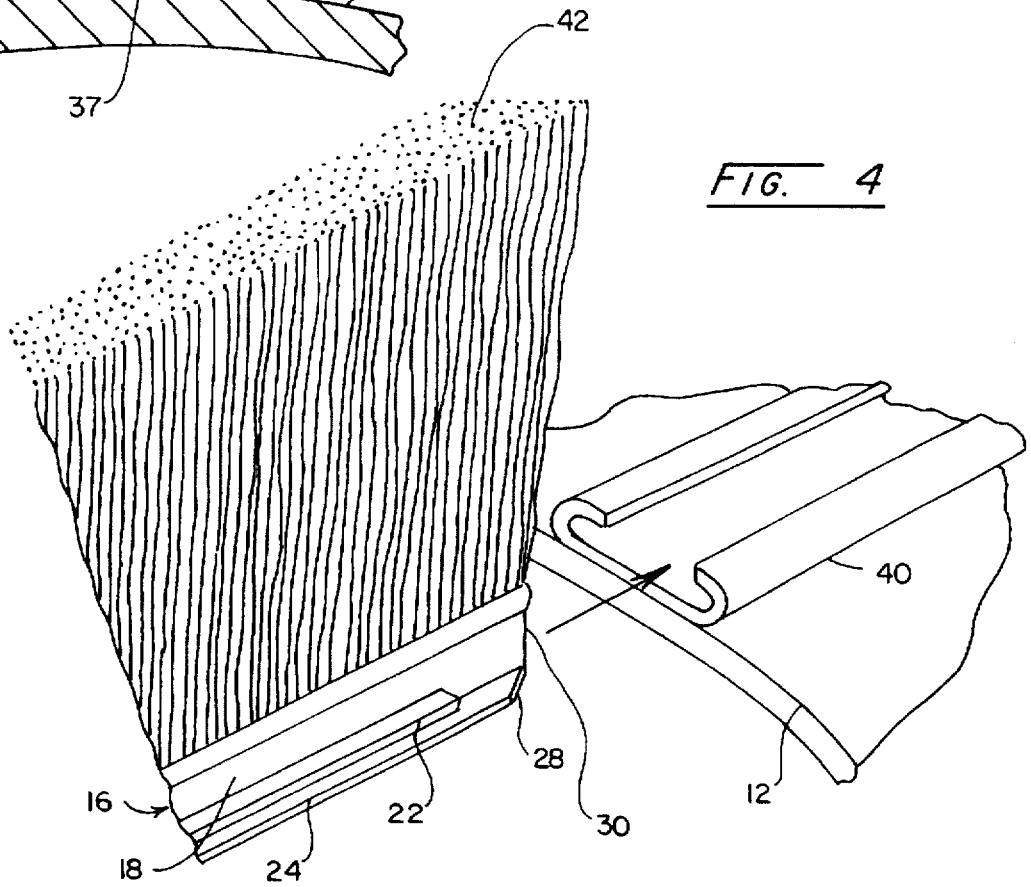
FIG. 4 is a perspective view of the bristle strip of the present invention aligned for sliding onto a track on a drum.

As seen most clearly in FIGS. 2 and 4, first flange 24 or second flange 26 includes a bevel or notch 28. In the preferred embodiment, both first flange 24 and second flange 26 will include a bevel 28. First flange 24 and second flange 26 extend the length of channel 16. First ear 22 and second ear 25 do not extend the full length of channel 16. Instead they terminate before reaching ends 30 and 36. One purpose of the first ear 22 and second ear 25 terminating before the front end 30 of channel 16 and first and second flanges 24, 26 including a bevel 28, is for ease of introduction of channel 16 onto track 40 attached to drum 12. The bevel 28 in particular assists in guiding channel 16 easily into track 40. It has another important function which will be explained subsequently in relation to FIG. 6.

Figure 5:
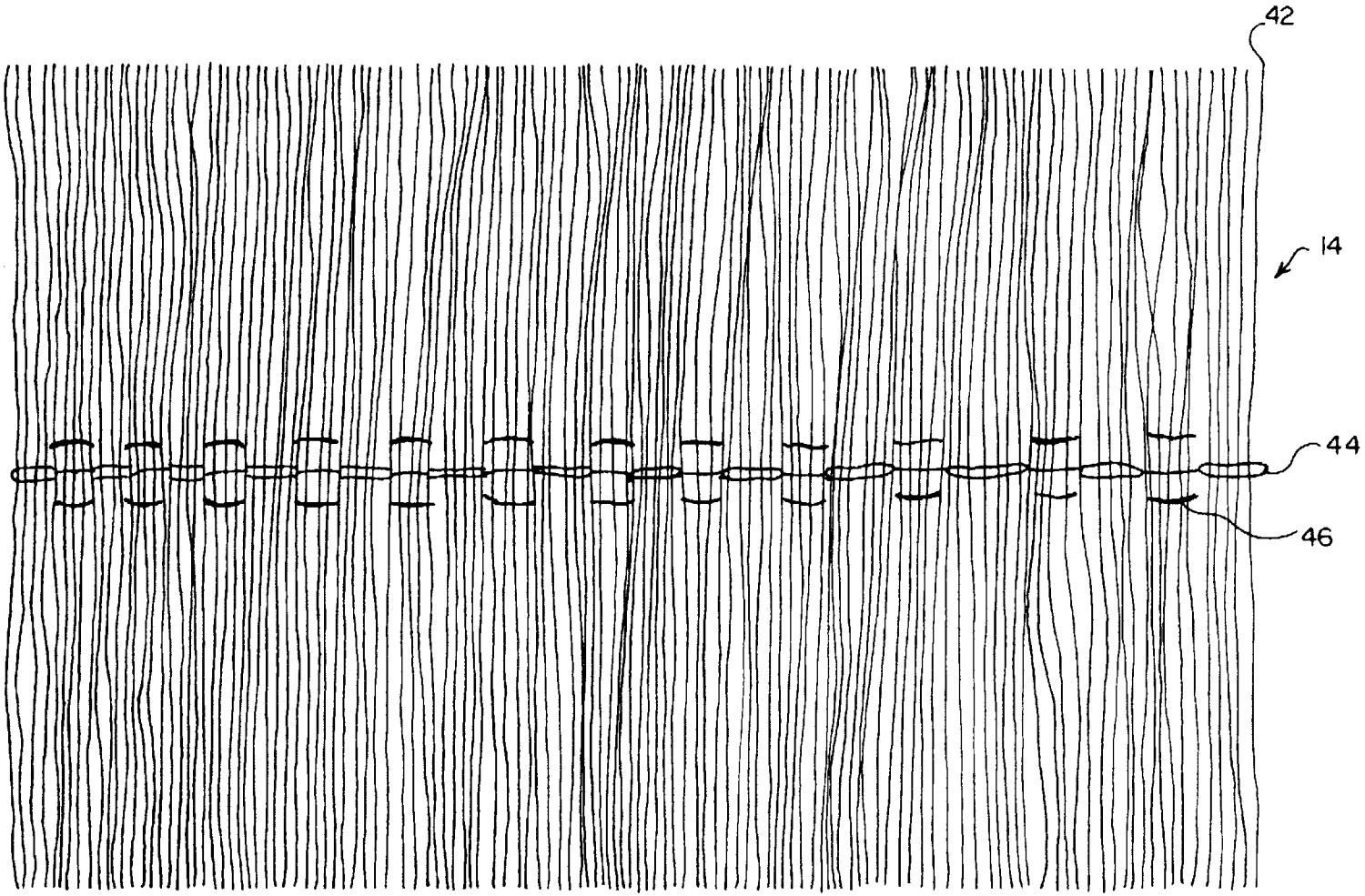
FIG. 5 is a mat according to one embodiment of the present invention.

As is best seen in FIGS. 3 and 5, mat 14 includes bristles 42 and securing strip 44. Securing strip 44 serves to secure together the bristles 42 of mat 14. Securing strip 44 may take any number of configurations. It may take the form of one or more wires 46 woven through bristles 42. However, it is preferred that five wires 46 be woven into bristles 42 to create mat 14 as shown in FIG. 5. Three of the wires will be woven approximately along the center line of bristles 42 and one wire will be on each side of and equidistant from the center line of bristles 42. An alternate securing strip is made of plastic. In this case, two plastic strips would be placed approximately one and one-half inches apart and equidistant from the center line of bristles 42. The plastic strips are preferably about one quarter of an inch wide and one thirty-second of an inch thick. Instead of being woven as wire 46, the plastic securing strip would be fused to bristles 42 with a hot wheel. By using this sort of securing strip 44, bristles 42 are less likely to loosen and detach from bristle strip 10. Once bristles 42 have been woven into mat 14, mat 14 is folded along its center line and placed in channel 16. Bristles 42 are preferably made of well known thermoplastic resin.

Figure 6:
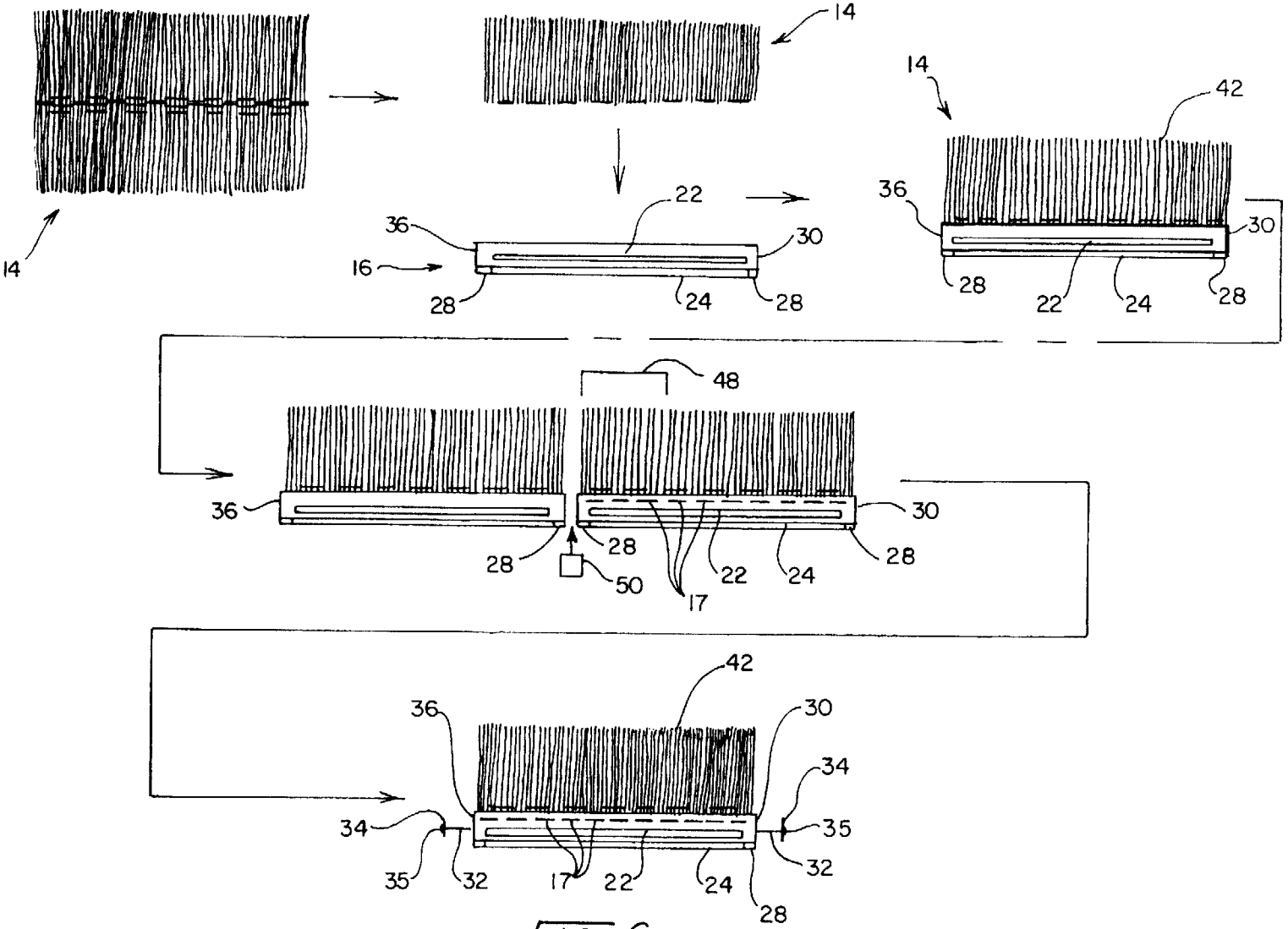
FIG. 6 is a view of the manufacturing process for making the product of the present invention.

As best seen in FIGS. 2 and 6, mat 14 is secured in channel 16 by means of staples 17. In order to ensure that all the bristles 42 in mat 14 are retained within channel 16, one staple 17 should be placed within one-half inch of front end 30 and one staple 17 should be placed within one-half inch of rear end 36. Staples 17 may be any of the conventional sort used and known in the art; however, each staple 17 must penetrate first side 18, mat 14 and a second side 20 in order to ensure that mat 14 remains securely in channel 16. It will also be known to one of ordinary skill in the art that other ways besides stapling may be used to secure mat 14 in channel 16. However, each securing means, i.e. nails, must penetrate all portions necessary to ensure stability. Staples 17 are preferably made of metal.

Even with appropriate placement of staples 17, it is possible that a certain number of bristles 42 will loosen from the ends mat 14 and channel 16 over time. It is therefore recommended that a nail 32 be placed in each of front end 30 and rear end 36 through the opening in the channel 16 to further ensure that all bristles 42 are retained within channel 16. If desired, a flange 34 may be placed around nail 32 to expand the area covered by nail 32. Nail 32 is preferably made of metal and a disc shaped flange 34 is preferably made of plastic. Observe in FIG. 2 that flange 34 projects radially of nail 32 such that it abuts the ends of upstanding arms 47, 49 such that bristles 42 cannot slip out of the end of channel 16. Clearly the head 35 of nail 32 could be made larger if desired and the disc shaped flange 34 would be unnecessary.

Attention is called to FIG. 3 which shows a V-shaped mouth 53 converging to inwardly projecting lips 55, 57 on the inside of arms 47, 49, respectively. The V-shaped mouth facilitates the spreading of arms 47, 49 when bristle mat 14 is forced into the tear drop recess 37. After a roller or blade type apparatus crams the bristle mat 14 into recess 37, the roller-blade is withdrawn and lips 55, 57 snap back into place to grip the bristles and hold them securely in place. Note that the facing surfaces of said arms 47, 49 are mirror images of each other.

Turning now to FIG. 6, it may be seen that mat 14 is folded and placed in recess 37 within channel 16. A number of channels 16, are aligned and then sent to stapling mechanism 48. It is important to ensure that in stapling mechanism 48 one staple 17 be placed within one half-inch of front end 30 of channel 16 and rear end 36 of channel 16. To achieve this, a sensor 50 is used. When a channel 16 reaches stapling mechanism 48, the stapler places a staple very close and within one-half inch of front end 30. It will then place staples at a preselected distance apart down the length of channel 16. Each staple 17 will penetrate through first side 18, mat 14 and second side 20 of channel 16. At some point thereafter, a second channel 16 will follow. Sensor 50 detects bevel 28 and signals stapling mechanism 48 that the end of the previous channel 16 has been reached. The stapling mechanism 48 can then place a final staple within one-half inch of the rear end 36 of channel 16. After receiving the final staple, the now assembled bristle strip 10 may be sent to another area where nail 32 and flange 34 are inserted within channel 16.

Having thus described the invention in its preferred embodiment it will be clear that other modifications may be made without departing from the spirit of the invention. Also the language used to describe the inventive concept and the drawings accompanying the application to illustrate the same, are not intended to be limiting on the invention. Rather, it is intended that the invention be limited only by the scope of the appended claims.

I claim:

1. A method of making a bristle strip comprising, providing a channel with a longitudinally extending recess, said recess having a generally V-shaped mouth formed by two generally parallel longitudinally extending arms, providing a bristle mat of about the same length as said channel, said mat comprising a plurality of linear bristles of about the same length, folding said linear bristles into a generally U-shape and placing the closed end of said U-shape in the mouth of said recess, spreading said arms by forcing said bristles into said recess and allowing said arms to return to their original position to grip said bristles and hold them in said recess, delivering a front end of said bristle holding strip to a stapler, triggering a signal by inserting said strip into said stapler which recognizes a chamfered front end of said strip and drives a staple through both arms and said bristle mat within one-half inch of said front end, moving said strip through said stapling machine while driving staples through said arms and bristle mat at spaced intervals, triggering said signal a second time by a chamfered rear end of said strip to cause said stapling machine to drive a staple through said arms and bristle mat within one-half inch of said rear end.

2. The method of claim 1 including driving a nail in each end of said strips to prevent individual strip from slipping longitudinally out of said recess.

3. The method of claim 2 including providing said nail with a large flange whereby, when said nail is driven into said strip ends, the flange abuts said arms.

4. The method of claim 3 wherein said flange comprises a disc penetrated by the shaft of said nail and sandwiched between the nail head and said arms.

* * * * *